US005456170A

United States Patent [19]

Bachmann

[11] Patent Number: 5,456,170

[45] Date of Patent: Oct. 10, 1995

[54] INK BALL PRINTING MACHINE

[75] Inventor: Louis Bachmann, Wil, Switzerland

[73] Assignee: Teca Print AG, Thayngen, Switzerland

[21] Appl. No.: 195,285

[22] Filed: Feb. 14, 1994

[30] Foreign Application Priority Data

Feb. 12, 1993 [CH] Switzerland ..... 439/93

[51] Int. Cl.[6] ..... B41F 17/00

[52] U.S. Cl. ..... 101/35; 101/41

[58] Field of Search ..... 101/35, 41–44, 101/163

[56] References Cited

U.S. PATENT DOCUMENTS

| | | | |
|---|---|---|---|
| 4,314,504 | 2/1982 | Combeau | 101/41 |
| 4,403,547 | 9/1983 | Forberger | 101/41 |
| 4,557,195 | 12/1985 | Phlipp | 101/167 |
| 4,615,266 | 10/1986 | De Roche et al. | 101/163 |
| 5,272,973 | 12/1993 | Chojnacki | 101/44 |

FOREIGN PATENT DOCUMENTS

| | | |
|---|---|---|
| 0086742 | 8/1983 | European Pat. Off. . |
| 0276537 | 8/1988 | European Pat. Off. . |
| 1923374 | 5/1972 | Germany . |
| 527699 | 10/1972 | Switzerland . |

OTHER PUBLICATIONS

Morlock Tampondruck-Systeme, Tampondruckmachine MTM100, May 5, 1988

Teca-Print AG, TC70 May 5, 1988

*Primary Examiner*—Edgar S. Burr
*Assistant Examiner*—Anthony H. Nguyen
*Attorney, Agent, or Firm*—Sughrue, Mion, Zinn, Macpeak and Seas

[57] ABSTRACT

An ink ball printing machine has a slide 45 movable back and forth on a base plate 1 by a drive 25. The slide includes a U-shaped support 8, which is built like a box and made of sheet metal. A printing apparatus 37 and an inking system 18, which can be moved with the slide, are attached to two legs 9, 10 which project beyond the machine housing 2 and belong to the support. The sheet metal support enables a very inexpensive and yet stable fabrication of the ink ball printing machine.

5 Claims, 3 Drawing Sheets

INK BALL PRINTING MACHINE

BACKGROUND OF THE INVENTION

This invention relates to an ink ball printing machine, comprising an inking system and a slide that can be moved back and forth in a housing to which a printing apparatus with a printing cushion is attached, and which can be moved by a drive horizontally between first and second positions to implement ink acceptance and transfer.

An ink ball printing machine of this type is known from CH-A-527 699, with which it is possible to print on flat and also uneven objects in a simple manner. After inking a block, the printing cushion, also called a dabber, is pressed on the block, lifted vertically and slid horizontally on two parallel guide columns, until the cushion is located above the object to be printed on. The object is then printed with a vertical movement of the cushion. A horizontal movement of the inking system is coupled with the horizontal movement of the printing cushion. It has been demonstrated that an ink ball printing machine with a stationary block is easier to operate than an ink ball printing machine with a movable block, which is known from DE-B-1 923 374. EP-B-0 086 742 also shows an ink ball printing machine with a stationary block. With this machine, however, the printing cushion is not moved horizontally in order to print on an object, but rather pivots around a horizontal axis.

The problem with an ink ball printing machine having a stationary block and a horizontally movable printing cushion is that the mounting or bearing system for the printing cushion is very complicated with respect to the requisite stability. Therefore, this invention is based on the problem of providing an ink ball printing machine of the above type that can be manufactured at a significantly lower cost and that still guarantees a high print quality.

SUMMARY OF THE INVENTION

The problem is solved with an ink ball printing machine according to the invention in that the slide has a box-shaped support and the printing apparatus is attached to the support. Such a support can be manufactured, on the one hand, very inexpensively and, on the other hand, very stably. The comparatively high stability allows the guide of the slide to be arranged on a base plate. This arrangement enables a significantly simpler assembly than before. Due to the high stability and strength of the support, the printing cushion will not vibrate very much even during rapid horizontal movements or strokes.

According to another embodiment of the invention the inking system is also attached to the support. Thus, with the horizontal movement of the slide the printing cushion and the inking system are moved simultaneously. Such a design is especially inexpensive, since the printing cushion and the inking system can be moved horizontally with a single drive, and at the same time a complicated gearing stepup is not required. The assembly is especially simple, since the slide with its guide and the inking system can be mounted on the base plate of the machine. The machine housing can also be made very inexpensively of sheet metal, since no guide rods or rails have to be mounted on the housing.

An especially stable and yet simple machine results from designing the slide in the shape of a U according to another embodiment of the invention, with the two legs oriented horizontally and arranged one above the other. In this design the printing apparatus is attached to the upper leg, whereas the inking system is attached to the lower leg. Preferably the drive's attack points are at the slide, whereas the guide of the slide is arranged on the underside of the leg. The result is a very good transfer of force and movement.

DETAILED DESCRIPTION OF THE PREFERRED EMBODIMENTS

Figure 1:
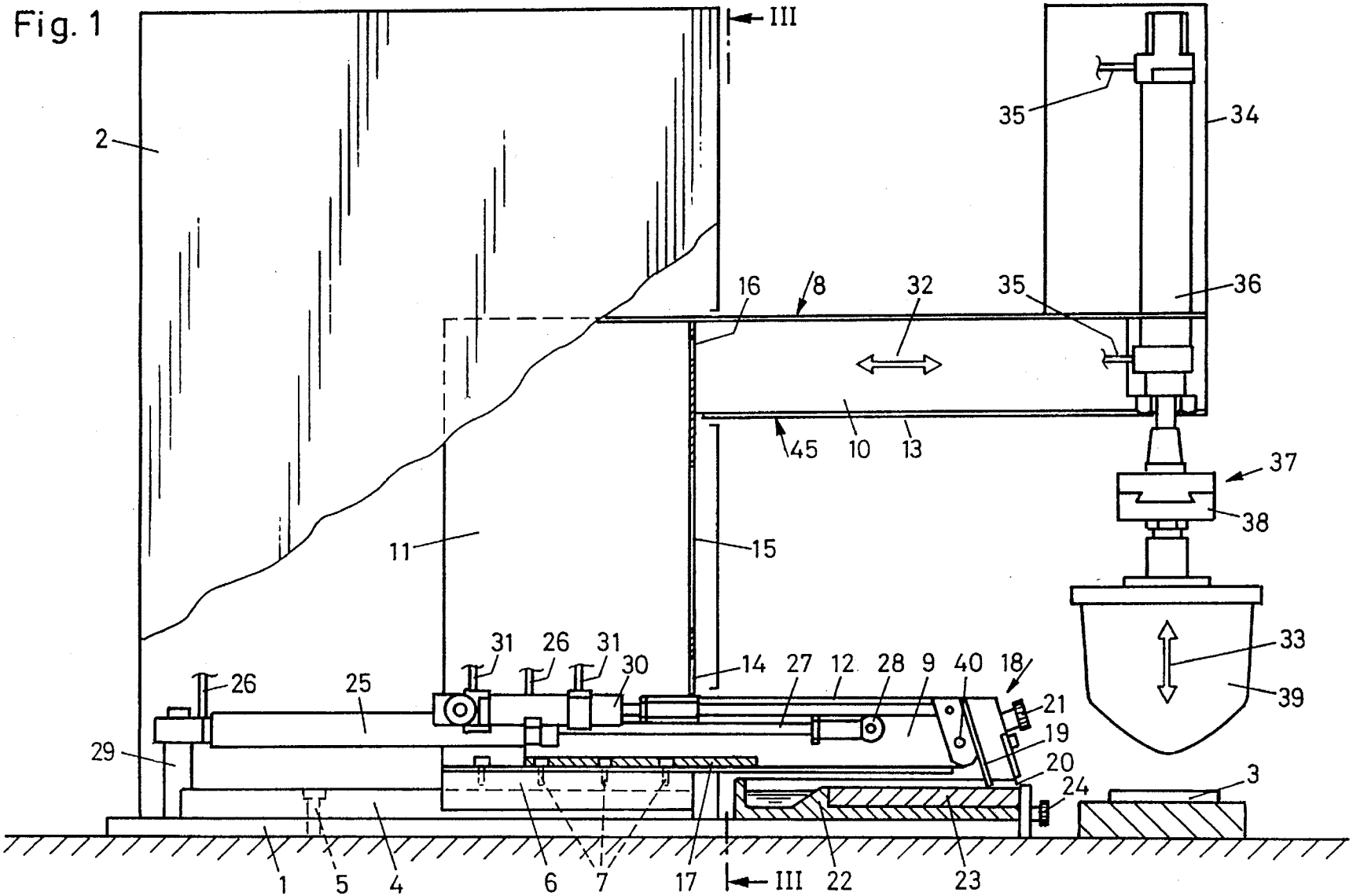
FIG. 1 is a fragmented view of an ink ball printing machine according to the invention.
Figure 2:
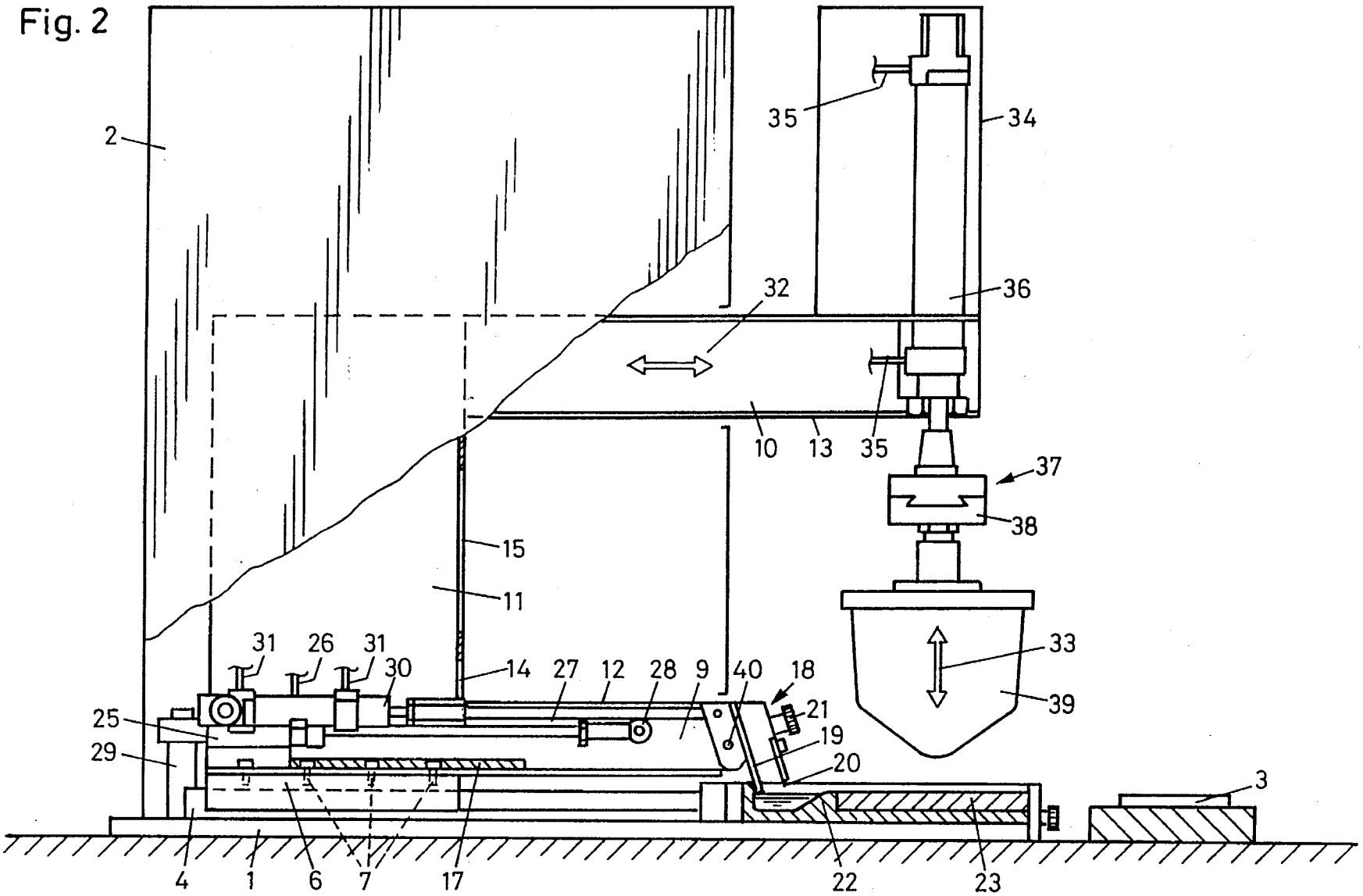
FIG. 2 is a view according to FIG. 1, but with the slide in another position.
Figure 3:
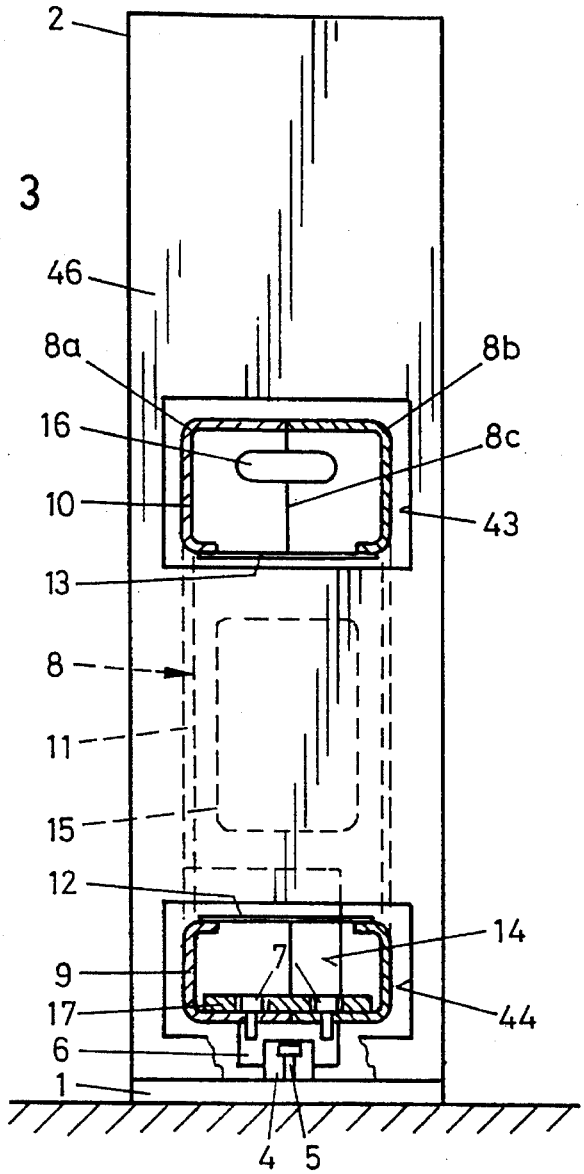
FIG. 3 is a view along line III—III of FIG. 1.

The ink ball printing machine shown in FIGS. 1 to 3 has a base plate 1, on which a machine housing 2 made of sheet metal, a slide 45, an ink container 22 and a block 23 are arranged. The slide can be moved horizontally by a cylinder-piston unit 25 in the directions of the double arrow 32. An object 3 to be printed is spaced from the base plate 1 such that in the position of the slide 45 according to FIG. 1 a printing cushion 39 attached to the slide 45 can be pressed against the object by a vertical movement.

The slide 45 comprises a U-shaped support 8, to whose underside is rigidly attached a guide 6 with a horizontally extending guide groove by means of a plate 17 and attachment screws 7. The guide sits on a rail 4, which is attached to the base plate 1 by screws 5. The slide 45 can be moved back and forth on the rail 4 by the double acting cylinder-piston unit 25, which has the usual fluidic connections 26. One end of the cylinder is hinged rigidly to the base plate 1 by a holder 29, and the free end of the piston 27 is hinged to a bottom leg 9 of the support 8 by a joint 28. The unit 25 is preferably operated pneumatically, but this unit can also be replaced by another suitable drive and in particular by a manual drive.

An inking system 18, which is known from EP-B-0 086 742, is attached to the front end of the leg 9. The inking system 18 can be pivoted around an axis 40 by a pneumatic, double acting cylinder-piston unit 30. The fluidic connections 31 of the unit 30 are shown schematically. The rear end of the unit 30 is hinged (FIG. 1) to the support 8 of the slide 45. Thus, the unit 30 is moved along with the slide. The inking system has a doctor blade 20 and an ink slice 19, both mounted on the inking system by a knurled-head screw 21. If the slide 45 in FIG. 1 is moved horizontally to the left, the doctor blade 20 strips excess ink from the block 23. If, in contrast, the slide 45 in FIG. 2 is moved to the right, the ink slice 19 takes ink from the ink container 22 and distributes it over the block.

The ink container 22 and the block 23 can be accurately aligned horizontally with the printing cushion 39 by a setscrew 24, and another setscrew (not illustrated).

The bottom leg 9 of the support 8 is rigidly connected by a vertical support member 11 to an upper leg 10, projecting outwardly through an opening 43 of a front wall 46 of the machine housing 2. As shown in FIG. 3, each leg 9 or 10 has a cover plate 12 and 13, which is attached, for example riveted, to a region of the leg 9 or 10 whose cross section is U-shaped. Thus, the legs 9 and 10 are made like a box out of sheet metal, and form stable parts of the support 8. The upper leg 10 is somewhat longer than the bottom leg 9 and carries on the top side at the front end a well-known machine part 34, in which a cylinder-piston unit 36 for exerting a vertical lift on the printing cushion 39 is housed. The double acting unit 36 is coupled by connections 35 in a well-known manner to pneumatic valves (not illustrated). A cross slide 38, connecting the unit 36 to the printing cushion 39, enables the horizontal alignment of the printing cushion 39.

In the position shown in FIG. 1, the unit 36 moves the printing cushion 39 for printing on the object 3 vertically towards the bottom. The counterforce exerted thus on the unit 36 is transferred by way of the upper leg 10 to the vertical support member 11 and from there to the slide guide and finally to the base plate 1. The base plate can, of course, be attached to a table or the like. The high stability of the support 8 allows this force transfer without any significant change in the shape of the slide 45.

The support 8 comprises two parts 8*a* and 8*b*, which are rigidly connected, for example welded, together along a vertical plane 8*c*. The parts 8*a* and 8*b* can be made from a punched metal plate in a simple and very inexpensive manner by rounding off. Punched openings 14, 15 and 16 serve for the passage of lines. The support 8 can be open in the rear. Any suitable sheet metal can be used for its fabrication; even composite materials or sheets of non-metallic suitable materials are conceivable. To increase the stability of the support, foaming or reinforcing elsewhere is also conceivable.

Figure 4:
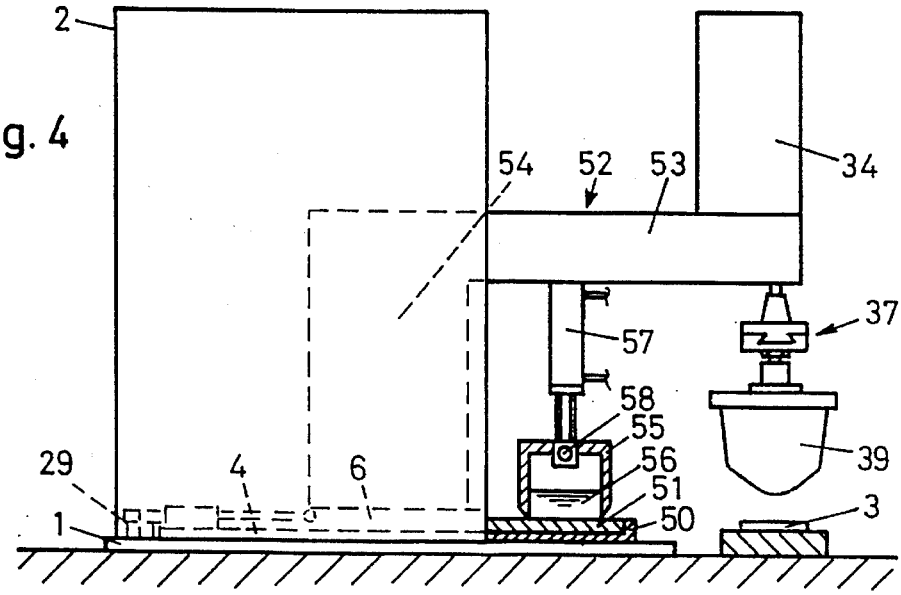
FIG. 4 is a diagrammatic view of the ink ball printing machine according to a modified version.

FIG. 4 shows another embodiment of the invention, where an L-shaped slide or support 52 is formed by a leg 53 and a vertical support member 54. The support 52 is made of sheet metal, as described above, and like the support 8 or the slide 45, it is guided on a base plate 1 and can be moved back and forth to a limited degree by a cylinder-piston unit 25. In contrast to the design described above, however, the inking system utilizes a well-known inverted ink pot 55, which is open at the bottom and which is attached at the top by a ball joint 58 to a cylinder-piston unit 57 fixed to the leg 53. The block 51 is inked in the known manner by moving the pot 55 back and forth, together with the ink 56 located therein. Since the ink pot and also the printing cushion 39 are connected rigidly to the support 52 or the slide, they are always moved simultaneously with the slide.

A design in which the ink pot 55 is connected to the vertical support member 54 is also conceivable, as is a design in which another inking system is provided. In a very simplified and inexpensive design the drive unit 25 can be omitted and the slide can be moved back and forth by hand. Moreover, a design, in which the block is moved back and forth and the inking system is held rigidly with respect to the housing 2, is conceivable. In this design only the printing apparatus 37 is moved back and forth with the slide and/or the support 52.

I claim:

1. An ink ball printing machine, comprising:

a) a stationary machine housing (2), b) a horizontally movable slide member (45) partially disposed within the housing and having a horizontal upper leg (10) extending outwardly through a wall of the housing, c) an ink block (23) disposed exteriorly of the housing, proximate thereto, and below said upper leg, d) an inking system (18) coupled to and movable with the slide member for applying ink to the block, e) a vertically movable printing cushion (39) mounted to an outer end of said upper leg, and f) drive means (25) for moving the slide member back and forth between a first position whereat the cushion is disposed above the block, and a second position whereat the cushion is disposed above an object (3) to be printed, g) wherein:

1) the slide member is rigid and unitary, has the shape of a U, with upper and lower horizontal legs (10, 9) arranged one above the other and individually fixed to a vertical support member (11), 2) the inking system is attached to the lower leg, and 3) the upper and lower legs are each made of two channel members (8*a*, 8*b*) rigidly connected together, and defining box beams.

2. An ink ball printing machine as claimed in claim 1, wherein the machine housing is attached to a base plate (1), and the slide member can be moved back and forth on the base plate.

3. An ink ball printing machine as claimed in claim 1, wherein the machine housing is made of sheet metal.

4. An ink ball printing machine as claimed in claim 3, wherein the slide member is made of sheet metal.

5. An ink ball printing machine as claimed in claim 1, wherein the drive means engages a bottom end of the slide member within the housing.

* * * * *